US009074749B2

(12) United States Patent
Seo et al.

(10) Patent No.: US 9,074,749 B2
(45) Date of Patent: Jul. 7, 2015

(54) DISPLAY APPARATUS

(71) Applicant: SAMSUNG ELECTRONICS CO., LTD., Suwon-si (KR)

(72) Inventors: Jeong-ryeol Seo, Seongnam-si (KR); Young-kook Kim, Seongnam-si (KR); Hyun-ah Kim, Incheon (KR); Ji-eun Park, Suwon-si (KR); Jin-ho Son, Hanam-si (KR); Seung-hun Lee, Anyang-si (KR); Ki-seok Choi, Osan-si (KR); Won-yong Choi, Seoul (KR); Yun-suk Choi, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 187 days.

(21) Appl. No.: 13/845,232

(22) Filed: Mar. 18, 2013

(65) Prior Publication Data

US 2013/0314923 A1 Nov. 28, 2013

(30) Foreign Application Priority Data

May 25, 2012 (KR) ..... 10-2012-0055996

(51) Int. Cl.

| | |
|---|---|
| ***F21V 7/00*** | (2006.01) |
| ***F21V 14/02*** | (2006.01) |
| ***A47F 11/06*** | (2006.01) |
| *A47F 7/02* | (2006.01) |

(52) U.S. Cl.
CPC . *F21V 7/00* (2013.01); *F21V 14/02* (2013.01); *A47F 7/02* (2013.01); *A47F 11/06* (2013.01)

(58) Field of Classification Search
None
See application file for complete search history.

(56) References Cited

U.S. PATENT DOCUMENTS

| | | | | |
|---|---|---|---|---|
| 2007/0103930 | A1* | 5/2007 | Lee et al. | 362/561 |
| 2010/0180615 | A1 | 7/2010 | Linder et al. | |
| 2013/0076999 | A1* | 3/2013 | Minami et al. | 349/15 |
| 2014/0218412 | A1* | 8/2014 | Hwangbo et al. | 345/690 |

FOREIGN PATENT DOCUMENTS

| | | | |
|---|---|---|---|
| DE | 20 2011 000 021 | U1 | 5/2011 |
| JP | 2000-146 | A | 1/2000 |
| JP | 2000-308551 | A | 11/2000 |
| KR | 10-1081617 | B1 | 11/2011 |

* cited by examiner

*Primary Examiner* — Ashok Patel
(74) *Attorney, Agent, or Firm* — Sughrue Mion, PLLC

(57) ABSTRACT

A display apparatus is provided. The display apparatus includes a transparent display panel, a reflector disposed in the display apparatus and configured to reflect light and provide the reflected light to the transparent display panel, a light emitter configured to emit the light and project the emitted light to the reflector, and a control circuit configured to control the transparent display panel and the light emitter.

10 Claims, 8 Drawing Sheets

DISPLAY APPARATUS

CROSS-REFERENCE TO RELATED APPLICATION

This application claims priority from Korean Patent Application No. 10-2012-0055996, filed on May 25, 2012, in the Korean Intellectual Property Office, the disclosure of which is incorporated herein by reference in its entirety.

BACKGROUND

1. Field

Apparatuses and methods consistent with exemplary embodiments relate to a display apparatus, and more particularly to, a display apparatus capable of displaying information on a display panel while viewing an object in a rear of the display panel.

2. Description of the Related Art

With the development of display panel technology, various kinds of display apparatuses are used in various fields. In particular, in recent years, research on the next-generation display apparatuses such as transparent display apparatuses has been accelerating.

The transparent display apparatuses are apparatuses which show a background in a rear thereof due to a transparent property. In the related art, the display panels are fabricated using opaque semiconductor compounds such as silicon (Si) or gallium arsenide (GaAs). However, as various application fields which cannot be supported by the related art display panel have been developed, efforts in the development of new type electronic devices have continued.

One of the devices developed by the efforts is the transparent display apparatus. The transparent display apparatus may be applied to windows of buildings or vehicles or display windows of stores so that the transparent display apparatus can provide functions such as advertisement, information provision, and display.

The transparent display apparatus is implemented using a structure including a transparent oxide semiconductor layer to have a transparent property. When the transparent display apparatus is used, the user can view a rear background positioned in the rear of the display apparatus and simultaneously view the desired information through a screen of the transparent display apparatus. Thus, it is possible to overcome spatial and temporal limitations in the display apparatus of the related art.

SUMMARY

One or more exemplary embodiments may overcome the above disadvantages and other disadvantages not described above. However, it is understood that one or more exemplary embodiment are not required to overcome the disadvantages described above, and may not overcome any of the problems described above.

One or more exemplary embodiments provide a display apparatus with an object disposed therein and a transparent display on one side thereof, and displayed information on the transparent display together with the internal object can be simultaneously viewed.

According to an exemplary embodiment, there is provided a display apparatus. The display apparatus may include: a transparent display panel configured to display information; a reflector disposed in the display apparatus and configured to reflect light and provide the reflected light to the transparent display panel; a light emitter configured to emit and project the light to the reflector; and a control circuit configured to control the transparent display panel and the light emitter.

The transparent display panel may be disposed on one surface of the display apparatus and the reflector may be disposed on an inner surface of the display apparatus facing the transparent display panel.

The light emitter may include a diffuser configured to diffuse the emitted light.

The light emitter may be disposed on at least one corner or one side of the transparent display panel inside the display apparatus to project the emitted light to the reflector.

The display apparatus may have a three-dimensional (3D) structure having a space inside which an object may be disposed.

The control circuit may be disposed below the display apparatus and one side of the display apparatus may be formed of a transparent material.

A first side of the display apparatus may include the transparent display panel configured to display the information and a second side of the display apparatus facing the first side may include the reflector.

Either side of the display apparatus may comprise the transparent display panel configured to display the information, and the transparent display panel may comprise a self-emission device.

The light emitter may further include a light emission adjuster configured to adjust a traveling angle of the light emitted by the light emitter.

The light emission adjusters may automatically control the light emitter and the reflector so that the light reflected by the reflector is uniformly projected to the transparent display panel according to a position of an object disposed inside of the display apparatus.

According to an exemplary embodiment, there is provided a display apparatus including a transparent display panel, and a light emitter, disposed on at least one side of the transparent display panel, configured to emit and project light. The display apparatus may also include a reflector disposed in the display apparatus and configured to reflect the emitted and projected light to the transparent display panel.

According to an exemplary embodiment, there is provided a display apparatus including a transparent display panel, and a light emitter, disposed on at least one corner of the transparent display panel, configured to emit and project light. The display apparatus may also include a reflector disposed in the display apparatus and configured to reflect the emitted and projected light to the transparent display panel.

According to the exemplary embodiments, it is possible to view information displayed in the transparent display unit while viewing the object disposed inside the display apparatus. The display apparatus may be used for advertisement to display merchandises inside the display apparatus and display description for the merchandises as display information and exhibition to exhibit artifacts in museum and obtain information associated with the artifacts through the transparent display unit.

Additional aspects and advantages of the exemplary embodiments will be set forth in the detailed description, will be obvious from the detailed description, or may be learned by practicing the exemplary embodiments.

BRIEF DESCRIPTION OF THE DRAWING FIGURES

The above and/or other aspects will be more apparent by describing in detail exemplary embodiments, with reference to the accompanying drawings, in which.

DETAILED DESCRIPTION OF THE EXEMPLARY EMBODIMENTS

Figure 1:
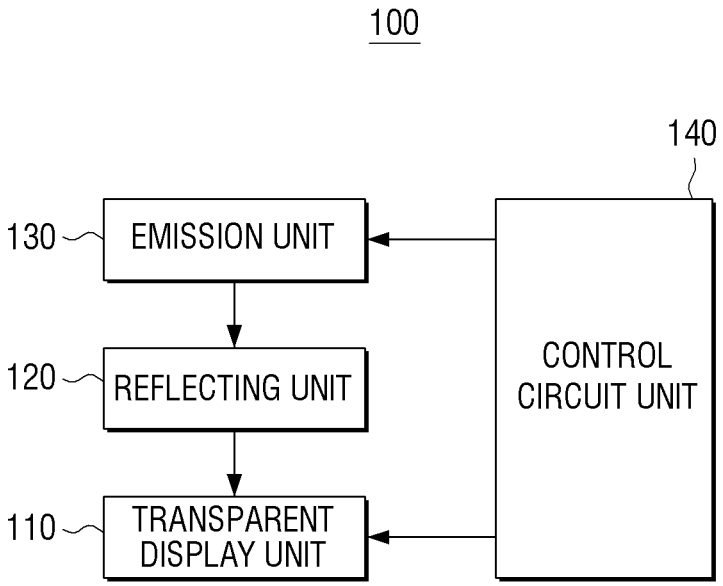
FIG. 1 is a block diagram illustrating a configuration of a display apparatus according to an exemplary embodiment.

Hereinafter, exemplary embodiments will be described in more detail with reference to the accompanying drawings.

In the following description, same reference numerals are used for the same elements when they are depicted in different drawings. The matters defined in the description, such as detailed construction and elements, are provided to assist in a comprehensive understanding of the exemplary embodiments. Thus, it is apparent that the exemplary embodiments can be carried out without those specifically defined matters. Also, functions or elements known in the related art are not described in detail since they would obscure the exemplary embodiments with unnecessary detail.

Figure 2:
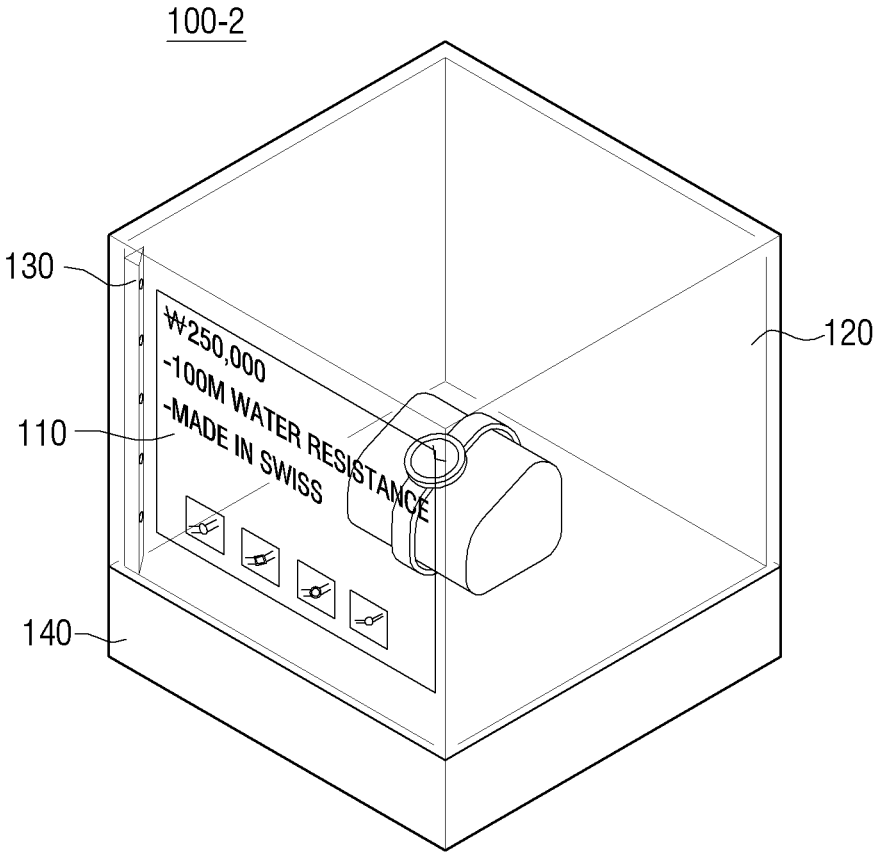
FIG. 2 is a conceptual view illustrating an external appearance of the display apparatus of FIG. 1.
Figure 3:
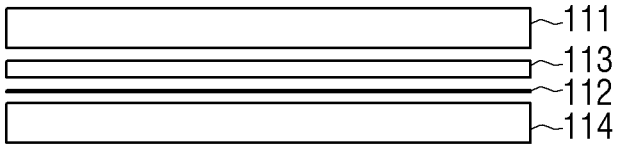
FIG. 3 is a reference view illustrating a cross-section of a transparent display unit.

FIG. 1 is a block diagram illustrating a configuration of a display apparatus 100 according to an exemplary embodiment, FIG. 2 is a conceptual view illustrating an external appearance of the display apparatus 100 of FIG. 1, and FIG. 3 is a reference view illustrating a cross-section of a transparent display unit 110.

Referring to FIGS. 1 and 2, the display apparatus 100 according to an exemplary embodiment includes the transparent display unit 110 (e.g., a transparent display, transparent display panel, etc.), a reflecting unit 120 (e.g., a reflector, a light reflector, etc.), an emission unit 130 (e.g., an emitter, a light emitter, etc.), and a control circuit unit 140 (e.g., a control circuit, a controller, etc.).

The transparent display unit 110 is configured to display information. The transparent display unit 110 serves to display information in a state in which an object located at a rear thereof may be viewed through the transparent display by applying a voltage to various kinds of transparent display devices. Here, the information may include images, text, reproduction screens of contents, execution screens of applications, web browser screens, various kinds of graphic objects, and the like. The object behind the transparent display may have a concrete shape and may include various things such as salable goods, animals, plants, furniture, walls, wallpapers, artifacts, etc.

The transparent display unit 110 may be implemented with various types of display panels such as a transparent liquid crystal display (LCD), a transparent thin-film electroluminescent panel (TFEL), a transparent organic light emitting display (OLED), and a projection display according to exemplary embodiments. Hereinafter, various exemplary embodiments of the transparent display units 110 will be described.

The transparent LCDs are transparent display apparatuses in which a backlight unit (BLU) is removed from the LCD apparatus currently used and which are implemented using a pair of polarization plates, optical films, thin film transistors (TFTs), transparent electrodes, and the like. Although the transparent LCD apparatus has a low transmittance due to the polarization plate or optical film and has a low optical efficiency due to use of peripheral light other than the backlight unit, the transparent display apparatus has an advantage when being used to implement a large-area transparent display. The transparent TFEL apparatus is an apparatus using an alternative current (AC) TFEL including a transparent electrode, an inorganic fluorescent body, and an insulating layer. The AC TFEL is a display in which electrons accelerated in the inorganic fluorescent body pass therethough to excite a fluorescent body and thus light is emitted. When the transparent display unit 110 is implemented with the TFEL type, the control circuit unit 140 may adjust the electrons to be projected to an appropriate position of the transparent display unit 110 and thus determine information display position. Since the inorganic fluorescent body and the insulating layer are transparent, it is possible to implement the TFEL apparatus having higher transmittance.

In addition, the transparent OLED apparatuses are transparent display apparatuses using self-emissive OLEDs. Since an organic emission layer is transparent, it is possible to implement the transparent display apparatus using both electrodes as transparent electrodes. In the OLED, electron and holes injected from the two electrodes to the organic emission layer and then combined in the organic emission layer to emit light. The transparent OLED apparatus injects the electrons and holes into the desired positions using the principle to display information.

Referring to FIG. 3, the transparent LCD-type transparent display unit 110 may include an upper transparent panel 111, a filter layer 112, an LCD panel 113, and a lower transparent panel 114.

The upper transparent panel 111 is disposed on an uppermost surface of the transparent display unit 110 and prevents the transparent display unit 110 from being damaged. The upper transparent panel 111 may be formed of a transparent acrylic material or a transparent polymer material. If necessary, the upper transparent panel 111 may be formed of a material such as hardened protection glass. The upper transparent panel 111 may be disposed to be spaced from an LCD panel 113 by a constant interval because the upper transparent panel 111 may be thermally deformed due to heat from the LCD panel 113 and because the endurance or life of the LCD panel 113 is degraded when the upper transparent panel 111 is in physical contact with the LCD panel 113.

The filter layer 112 is interposed between the LCD panel 113 and a light source to uniformly transfer the projected light toward the LCD panel 113.

In addition, the lower transparent panel 114 is formed of the same material as the upper transparent panel 111 and may be disposed below the LCD panel 113 to be spaced from the LCD panel 113. The lower transparent panel 114 is configured to support the LCD panel 113 and the filter layer 112 disposed below the LCD panel 113. Hardened protection glass may replace the lower transparent panel 114.

The LCD panel 113 is configured to convert various electrical information into visual information using a variation of liquid crystal (LC) transmittance according to an applied voltage and transfer the converted visual information. The LCD panel may include a lower glass substrate in which transparent TFTs and pixel electrodes are arranged, an upper glass substrate (not show) including a color filter for representing colors and a transparent common electrode, and LC filled between the two glass substrates. A polarization plate configured to linearly polarize visible light (sunlight) is attached to each of the two glass substrates. A capacitor formed by the LC interposed between upper and lower electrodes and a subsidiary capacitor are provided to represent image information.

The transparent TFT is a transistor fabricated by replacing opaque silicon of the transistor with a transparent material such as zinc oxide or titanium oxide and forming a layer of the LCD panel 113. A source, gate, and drain of a TFT may be provided in the transparent TFT layer. A plurality of transparent TFT, which are uniformly arranged on an entire area of a display surface, may be provided on the transparent TFT layer. The control circuit unit 140 to be described later may apply a control signal to the gate of each of the TFTs in the transparent TFT layer to drive the corresponding TFT so that information may be displayed.

Each of the transparent electrodes includes a plurality of line electrodes and the line electrodes of the upper glass substrate are arranged perpendicular to the line electrodes of the lower glass substrate. For example, when the line electrodes of a first transparent electrode are arranged in a vertical direction, the line electrodes of a second transparent electrode are arranged in a horizontal direction. Therefore, a plurality of intersection areas between the first transparent electrode and the second transparent electrode. Each of the transparent TFTs is connected to each of the intersection areas.

Indium tin oxide (ITO) may be used as the transparent electrode. Alternatively, a new material such as graphene may be used as the transparent electrode. The graphene is a transparent material in which carbon elements are connected to each other to form a honey-comb shaped-plane structure.

When the transparent TFT constituting a pixel is turned on by applying a voltage to a gate thereof, the LC enters a state in which image information is to be input thereto. Then, an image voltage is applied to store the image information in the LC and when the transparent TFT is turned off, the image is displayed for a constant period of time by charges stored in the LC capacitor and the subsidiary capacitor. When the voltage is applied, the arrangement of the LC is changed, the light is transmitted and diffracted through the LC and the diffracted light is transmitted through the polarization plate to obtain the desired image.

The reflecting unit 120 is disposed inside the display apparatus 100 and is configured to reflect light and provides the reflected light to the transparent display unit 110. The transparent display unit 110 may be configured of a non-self-emissive device, for example, an LCD and may not include a backlight unit (BLU) configured to provide a light source. When the backlight unit is included, the backlight unit is disposed at a rear of the transparent display unit 110. Therefore, an image at the rear of the transparent display unit 110 is not transmitted and thus the transparent display can not be obtained. However, when the backlight unit is removed, the transparent display unit has to use peripheral light such as sunlight and thus luminance and color reproduction are considerably degraded.

Therefore, the display apparatus 100 including an emission unit 130 corresponding to the backlight unit reflects the light emitted from the emission unit 130, and provides the reflected light to the transparent display unit 110 to obtain a sufficient light source so that higher quality luminance and color reproduction may be achieved. As described later, the display apparatus 100 may have a 3D structure including a space inside which an object 'a' is to be disposed and the reflecting unit 120 may be formed to be spaced from the transparent display unit 110 with the space interposed between the transparent display unit 110 and the reflecting unit 120. The light emitted from the emission unit 130 is reflected by the reflecting unit 120 and transferred to the transparent display unit 110 across the inner space of the display apparatus 100. Therefore, a user outside the display apparatus 100 can view information displayed through the transparent display unit 110 together with the object 'a' disposed in the space.

The emission unit 130 is configured to emit light and project the light to the reflecting unit 120 and may include a cold cathode fluorescent lamp (CCFL) or a plurality of light emitting devices (LEDs).

The control circuit unit 140 controls an operation of the display apparatus 100. Specifically, the control circuit unit 140 controls operations of the emission unit 130 and the transparent display unit 110 for the voltage to be applied to the transparent display unit 110.

The display apparatus includes the above-described components and emits light and reflects the light to provide a light source to the transparent display unit 110 so that required information can be displayed through the transparent display unit 110.

According to an exemplary embodiment, as shown in FIG. 2, the transparent display unit 110 may be disposed on one surface of the display apparatus 100 and the reflecting unit 120 may be disposed on an inner surface of the display apparatus 100 facing the transparent display unit 110. In this case, the light emitted from the emission unit 130 is reflected by the reflecting unit 120 on the inner surface of the display apparatus 100 facing the transparent display unit 110 and the reflected light is provided to the transparent display unit 110. Therefore, the sufficient light source is provided to display clear information. Further, since the space is formed between the transparent display unit 110 and the emission unit 130, when the object is disposed in the space, the object and information displayed in the transparent display unit 110 can be viewed.

Figure 4:
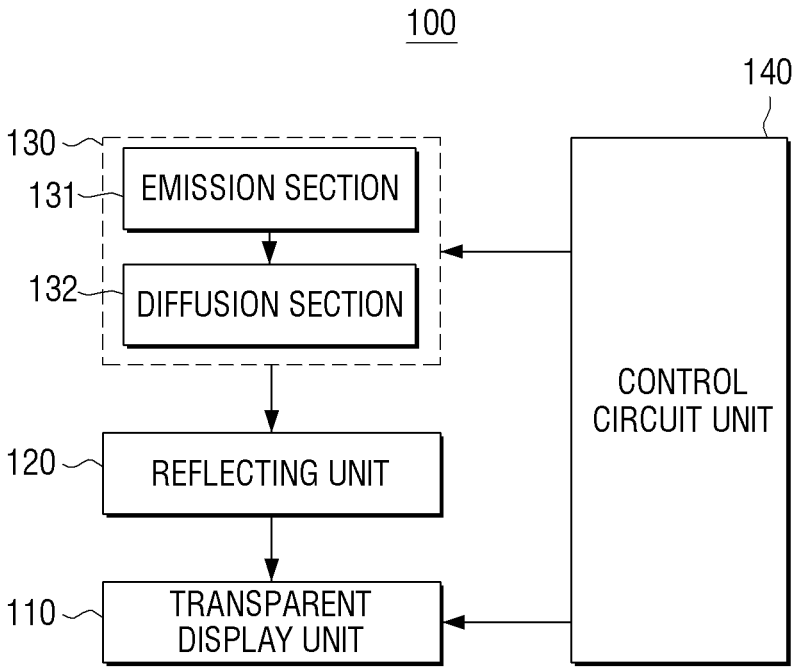
FIG. 4 is a block diagram illustrating a configuration of a display apparatus according to an exemplary embodiment.

FIG. 4 is a block diagram illustrating a configuration of a display apparatus 100 according to an exemplary embodiment.

Referring to FIG. 4, in the display apparatus 100, an emission unit 130 may include a diffusion section 132 (e.g., a light diffuser) configured to diffuse emitted light.

The diffusion section 132 is configured to diffuse the light. Specifically, the diffusion section 132 is a semi-transparent component which diffuses light emitted from a dot light source or a linear light source along a surface and passes the light with uniform color and brightness. For example, the diffusion section 132 is fabricated in a film shape or a shape, in which an inclination is maintained and thus the light is uniformly diffused, using a high-purity acrylic resin. The diffusion section 132 may be omitted when a uniform surface light source is used.

Figure 5:
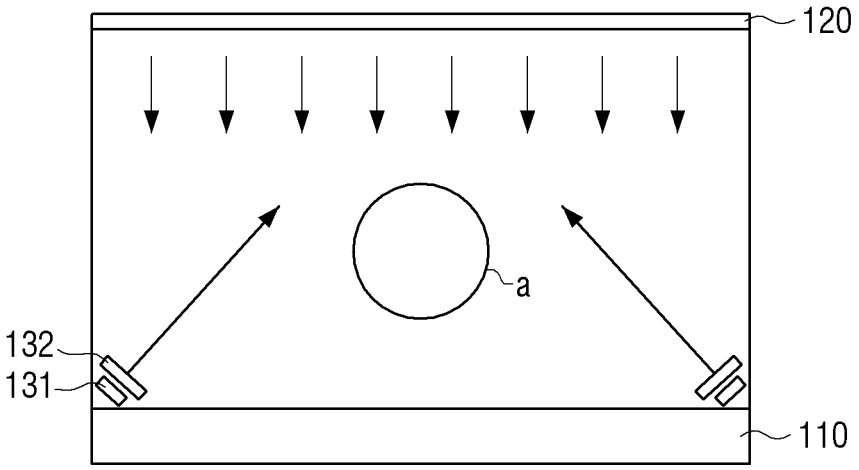
FIG. 5 is a horizontal cross-sectional view of a display apparatus illustrating an arrangement of an emission unit according to an exemplary embodiment.
Figure 7:
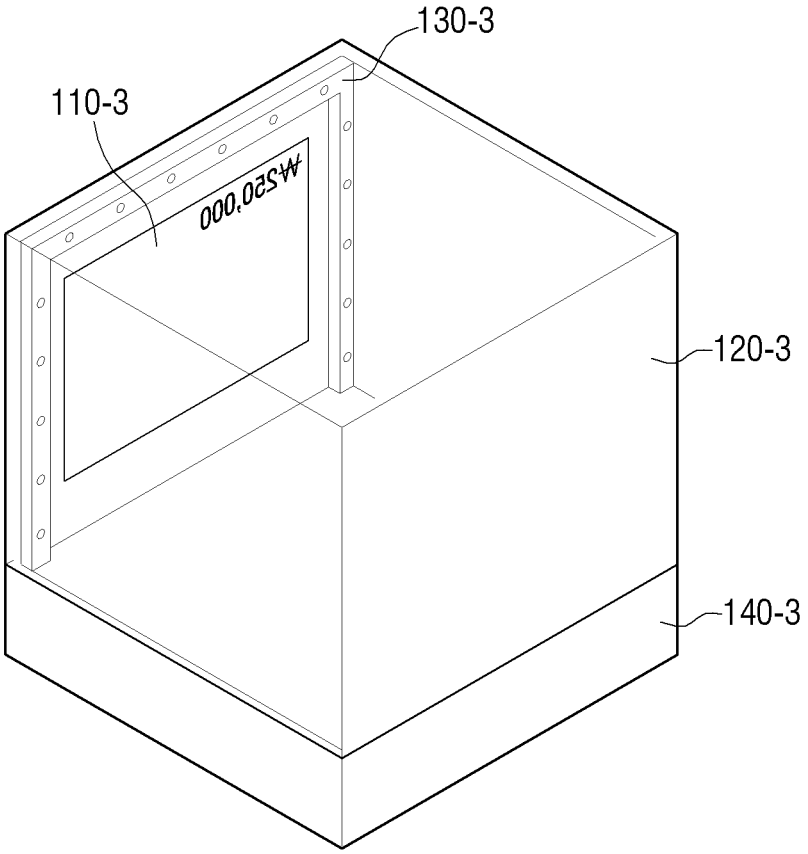
FIG. 7 is a conceptual view illustrating a display apparatus including emission units on three corners of a transparent display unit according to an exemplary embodiment.

FIG. 5 is a horizontal cross-sectional view of a display apparatus 100 illustrating arrangement of an emission unit 130 according to an exemplary embodiment. FIG. 7 is a conceptual view a display apparatus 100-3 including emission units on three corners of a transparent display unit according to an exemplary embodiment.

Figure 6:
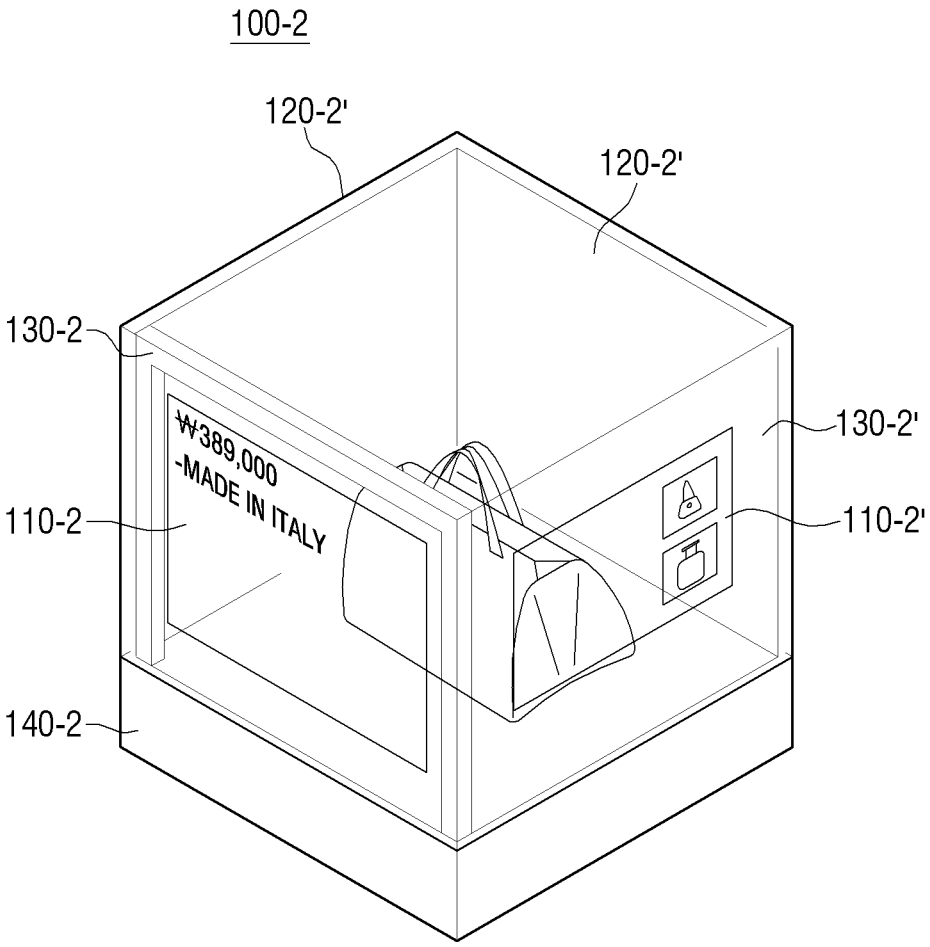
FIG. 6 is a conceptual view illustrating a display apparatus including a transparent display unit and a side thereof according to an exemplary embodiment.

Referring to FIGS. 5, 6 and 7, the emission unit 130, 130-2, or 130-3 may be disposed on at least one of the corners of the transparent display unit 110, 110-2, or 110-3 inside the display apparatus 100 and project the light to the reflecting unit 120. That is, as shown in FIGS. 5 and 7, when the light emitted through an emission section 131 disposed on left and right corner areas of the transparent display unit 110 or 110-3 is diffused through the diffusion section 132 and projected to the reflecting unit 120 or 120-3, the reflecting unit 120 or 120-3 reflects the projected light toward the transparent display unit 110 or 110-3. In particular, FIG. 7 illustrates an exemplary embodiment including the emission units on three corners of the transparent display unit.

Further, the display apparatus 100 according to various exemplary embodiments described above may have a 3D structure including a space which an object 'a' is disposed inside the display apparatus 100. That is, the transparent display unit 110 is disposed in a front of a rectangular parallelepiped as shown in FIG. 2, an empty space is formed inside the rectangular parallelepiped, and the object is disposed in the empty space. In this case, the display information can be viewed through the transparent display unit 110 together with the object inside the display apparatus 100.

Sides of the display apparatus 100 are formed to be transparent so that the object inside the display apparatus 100 is viewed at various angles. In this case, the control circuit unit 140, 140-2, or 140-3 is disposed below the display apparatus 100. That is, when the sides of the display apparatus 100 are transparent, all sides other than the rear side in which the reflecting unit 120 is disposed are transparent and thus the control circuit unit 140 is disposed below the display apparatus 100.

FIG. 6 is a conceptual diagram of a display apparatus 100-2 including a transparent display unit on a side thereof according to an exemplary embodiment.

As shown in FIG. 6, a transparent display unit configured to display information may be further included on a side of the display apparatus. When a transparent display unit 110-2' is further included on one side of the display apparatus 100-2, the reflecting unit 120-2' is provided in an inner surface of the display apparatus facing the transparent display unit 110-2' and the emission unit 130-2' is provided in a corner of the transparent display unit 110-2' around the emission unit 130-2'. Therefore, the clear and bright display information can be obtained as in the above-described exemplary embodiment. In this case, the clear image and the internal object can be viewed through the two sides (front side and one side) of the display apparatus 100-2.

Alternatively, the transparent display units are further included in both sides of the display apparatus. In this case, the transparent display unit is configured with a self-emissive device such as an OLED to overcome a spatial limit of an emission unit.

Figure 8:
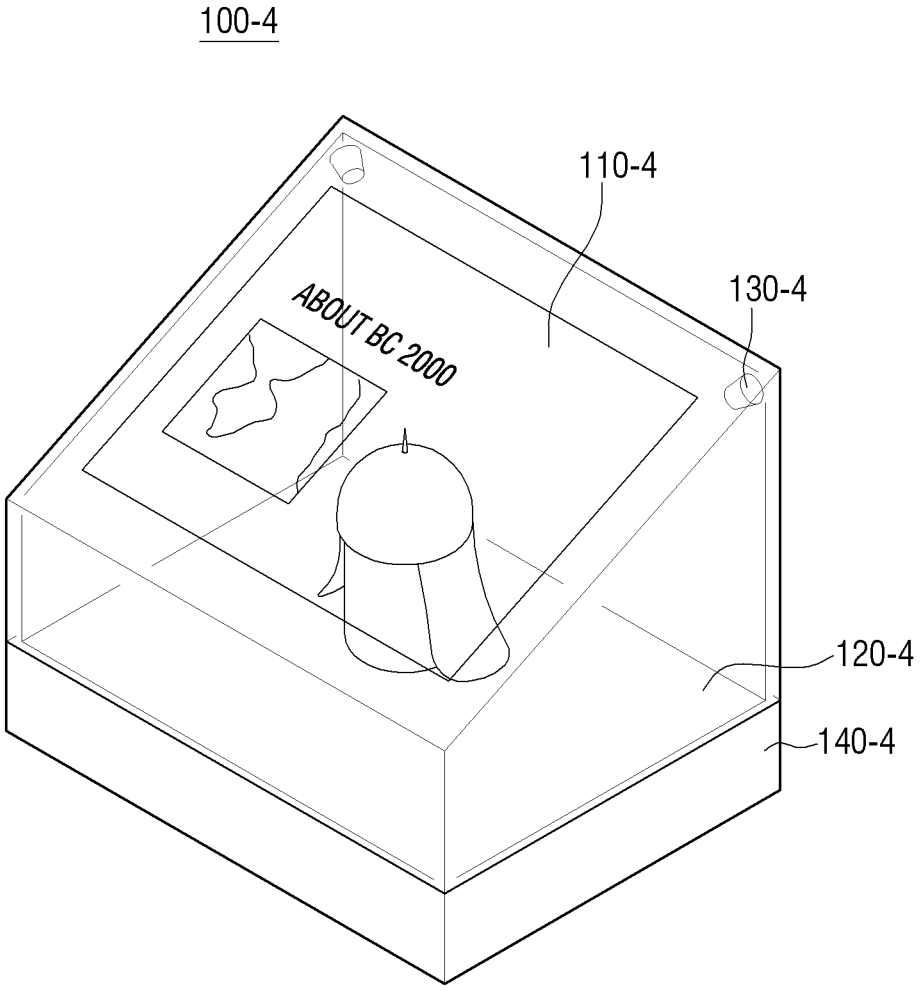
FIG. 8 is a conceptual view illustrating a display apparatus according to an exemplary embodiment.

As discussed above, a display unit may be provided in a top of a display apparatus 100-4. As shown in FIG. 8, in the display apparatus 100-4 according to an exemplary embodiment, a transparent display unit 110-4 is disposed in the top of the display apparatus 100-4 and emission units 130-4 are disposed in upper corners inside the display apparatus 100-4. When the emission unit 130-4 emits light, the light is reflected by the reflecting unit 120-4 disposed on a bottom inside the display apparatus 100-4 and the light source is transferred to the transparent display unit 110-4. In the exemplary embodiment of FIG. 8, the display apparatus 100-4 has a shape in which a top surface has a constant angle with respect to a horizontal plane other than a rectangular parallelepiped. Thus, the user can view the internal object and the display information in a comfortable gesture. FIG. 8 illustrates an example in which artifacts are exhibited in a museum and information associated with the artifacts is displayed through the transparent display unit 110-4.

Since the light reflected by the reflecting unit 120-4 may be interrupted according to a size or a position of the object 'a' disposed inside the display apparatus, a display apparatus according to an exemplary embodiment may further include an emission adjustment unit configured to adjust a traveling angle of the light emitted by an emission unit.

The emission adjustment unit includes a function to automatically control an emission unit and a reflecting unit for light reflected by the reflecting unit to be uniformly projected according to a position of the object disposed inside the display apparatus.

According to various exemplary embodiments, it is possible to view the object inside the display apparatus through the transparent display unit together with the information displayed in the transparent display unit. The display apparatus may be used for advertisement in which goods are exhibited inside the display apparatus as shown in FIG. 2 and a description for the goods that are displayed as display information. Alternatively, the display apparatus may be used for exhibition in which artifacts are exhibited in a museum and information associated with the artifacts is obtained through the transparent display unit. The display apparatus may be widely used in various industries and business fields.

The foregoing exemplary embodiments and advantages are merely exemplary and are not to be construed as limiting the present inventive concept. The exemplary embodiments can be readily applied to other types of apparatuses. Also, the description of the exemplary embodiments is intended to be illustrative, and not to limit the scope of the claims, and many alternatives, modifications, and variations will be apparent to those skilled in the art.

What is claimed is:

1. A display apparatus, comprising:

a transparent display panel;

a reflector disposed in the display apparatus and configured to reflect light to the transparent display panel;

a light emitter configured to emit and project the light to the reflector;

a control circuit configured to control the transparent display panel and the light emitter; and a light emission adjuster disposed on one side of the display apparatus configured to adjust a traveling angle of the light emitted by the light emitter.

2. The display apparatus as claimed in claim 1, wherein the transparent display panel is disposed on one surface of the display apparatus and the reflector is disposed on an inner surface of the display apparatus facing the transparent display panel.

3. The display apparatus as claimed in claim 1, wherein the light emitter includes a diffuser configured to diffuse the light.

4. The display apparatus as claimed in claim 1, wherein the light emitter is disposed on at least one side of the transparent display panel inside the display apparatus.

5. The display apparatus as claimed in claim 1, wherein the display apparatus has a three-dimensional (3D) structure having a space inside.

6. The display apparatus as claimed in claim 1, wherein the control circuit is disposed below the display apparatus and one side of the display apparatus is formed of a transparent material.

7. The display apparatus as claimed in claim 1, wherein a first side of the display apparatus includes the transparent display panel and a second side of the display apparatus facing the first side includes the reflector.

8. The display apparatus as claimed in claim 1, wherein the transparent display panel comprises a self-emissive device.

9. The display apparatus as claimed in claim 1, wherein the light emission adjuster automatically controls the light emitter and the reflector so that the light reflected by the reflector is uniformly projected to the transparent display panel according to a position of an object disposed inside of the display apparatus.

10. A display apparatus, comprising:

a transparent display panel disposed on one side of the display apparatus;

a light emitter, disposed on at least one side of the transparent display panel, configured to emit and project light;

a reflector disposed in the display apparatus and configured to reflect the emitted and projected light to the transparent display panel;

at least one transparent panel disposed on a plane that intersects a plane of the transparent display panel; and a light emission adjuster disposed on one side of the display apparatus configured to adjust a traveling angle of the light emitted by the light emitter.

* * * * *